United States Patent [19]

Fece

[11] Patent Number: 4,909,125

[45] Date of Patent: Mar. 20, 1990

[54] PERCUSSION INSTRUMENT IN THE NATURE OF A DRUM

[76] Inventor: Ivan Fece, 408 W. 39th St., New York, N.Y. 10018

[21] Appl. No.: 335,681

[22] Filed: Apr. 10, 1989

[30] Foreign Application Priority Data

Apr. 12, 1988 [YU] Yugoslavia ..... 734/88

[51] Int. Cl.[4] ..... G10D 13/02

[52] U.S. Cl. ..... 84/411 A; 84/413

[58] Field of Search ..... 84/411 A, 413

[56] References Cited

U.S. PATENT DOCUMENTS 2,706,925 4/1955 Fendlason ..... 84/413

4,570,526 2/1986 Horshino ..... 84/413

FOREIGN PATENT DOCUMENTS 8553 of 1886 United Kingdom ..... 84/411 A

OTHER PUBLICATIONS

Remo, Inc., Drums, Percussion & Accessories/1988.

*Primary Examiner*—Lawrence R. Franklin

*Attorney, Agent, or Firm*—McAulay Fisher Nissen & Goldberg

[57] ABSTRACT

A percussion instrument in the nature of a drum is disclosed having a shell-like body and a pair of elastic top and bottom drum heads. A hoop is provided to stretch the top drum head across the top of the drum body and a stretching wheel is provided for stretching the bottom drum head across the bottom of the drum body. The top and bottom drum heads vibrate at a pitch level proportional to the tension produced in each drum head. The stretching wheel is rotatably mounted on the top end of a shaft positioned below the drum body. A coupling wheel is threadably engaged to the shaft and is peripherally connected to the hoop by a set of elongated tension rods. Rotation of the percussion instrument on the shaft causes the rods to exert a downward force on the hoop and concurrently therewith produce an upward reactive force at the top of the shaft on the stretching wheel to simultaneously stretch the top and bottom drum heads across the top and bottom of the body, and thereby to simultaneously adjust the pitch level in each of the top and bottom drum heads.

9 Claims, 2 Drawing Sheets

PERCUSSION INSTRUMENT IN THE NATURE OF A DRUM

BACKGROUND OF THE INVENTION

1. Field of the Invention

This invention relates generally to a percussion instrument in the nature of a drum having a shell-like body and a pair of elastic top and bottom drum heads stretched across the body for vibrating at a pitch level proportional to the tension produced in each of the drum heads. More particularly, the invention relates to a drum in which the pitch level in each of the top and bottom drum heads is simultaneously adjustable by simultaneous adjustment of the tension in each of the drum heads.

2. Description of the Prior Art

In one common type of percussion instrument in the nature of a drum, a pair of elastic top and bottom heads are stretched across the top and bottom of a shell-like body. The top drum head is adapted to be set in vibration when beaten by hand or with some other implement, such as a drumstick or a wire brush. Air within the drum body resonates to propagate the vibration of the top drum head to the bottom drum head. The pitch level in each of the top and bottom heads and, therefore, the pitch level of the sound produced by the drum, is proportional to the tension produced in each of the top and bottom drum heads.

Generally, the drum body is of cylindrical configuration. Each of the top and bottom drum heads comprises a circular, elastic central portion of greater diameter than the drum body and an essentially rigid outer band portion peripherally connected to the central portion. A pair of top and bottom hoops are provided to bear against the outer band portions of the top and bottom drum heads, respectively, to stretch their central portions across the top and bottom of the drum body.

Each of the top and bottom hoops is attached to the drum body by a set of circumferentially spaced, threaded tension rods that are connected to the outer surface of the drum body. The tension rods pass through a set of circumferentailly spaced bores provided in each of the top and bottom hoops. A set of nuts, provided for each tension rod, is threaded onto the ends of the tension rods and tightened against each of the top and bottom hoops. The tension, and thus the pitch level, produced in each of the top and bottom drum heads is proportional to the degree to which the nuts are tightened against the top and bottom hoops.

The adjustment of the pitch level in each of the top and bottom drum heads is a two-step process. For example, the top drum head is struck in order to ascertain the pitch level of the sound emanating from the percussion instrument, and then, each of the top nuts is alternately tightened or lossened to adjust the pitch level in the top drum head. The process is then repeated for the bottom drum head in conjunction with the bottom nuts. Often, the two-step process must be repeated several times to obtain the desired pitch level. As will be appreciated, since rotational movement must be applied to each of the nuts in order to tighten and loosen the nuts, the pitch level adjustment of such a drum is an extremely complex and time consuming process.

In another type of drum, only a single rotational movement is required for adjustment of the pitch level. In this type of drum, however, only a single drum head is used. The central portion of such drum head is stretched across a stretching wheel by a single hoop bearing against the outer band portion of the drum head. The stretching wheel is rotatably mounted on the top end of a threaded shaft. A coupling wheel, threadably engaged on the shaft, is peripherally connected to the hoop by a set of tension rod. The arrangement is such that the coupling wheel, tension rod, hoop, drum head and stretching wheel are operatively connected together for conjoint rotation on said shaft. Accordingly, selected rotation of the coupling wheel, and the operatively connected elements, serves to stretch the central portion of the drum head across the stretching wheel to adjust the pitch level in the drum head. That is, rotation of the coupling wheel is one direction increases the pitch level of the drum head and rotation in an opposite direction decreases the pitch level of the drum head. An example of such an instrument is shown in the catalog of Remo, Inc., North Hollywood, California, and marketed under the name REMO ROTOTOMS.

The simplified pitch level adjustment of a percussion instrument of the type that uses only a single drum head, as described above, has not heretofore been applied to a drum having a pair of top and bottom drum heads. In a drum that has a pair of top and bottom drum heads, the top drum head must be stretched across the top of the body, rather than a wheel, so that vibrations propagate through the air in the body to the bottom drum head. Moreover, even if by some manner of design, the top drum head could be simultaneously stretched across a wheel and the top of the body, the bottom drum head would prevent the stretching wheel from being mounted on the top end of the shaft. Still further, there is no known mechanism to simultaneously stretch and adjust the pitch level in the bottom drum head at the moment the pitch level in the top drum head is being adjusted.

SUMMARY OF THE INVENTION

The present invention provides a percussion instrument in the nature of a drum that includes a shell-like body and a pair of elastic top and bottom drum heads. The pitch level in each of the top and bottom drum heads is simultaneously adjustable by a single movement of the drum body that may be rotational.

The top and bottom drum heads are adapted to be stretched across the top and bottom of the body for vibrating at a pitch level portional to the tension produced in each of the heads. In the present invention, unlike a percussion instrument that has a single adjustable pitch drum head, a pair of top and bottom stretching mechanism are provided to engage the top and bottom drum heads, respectively, for stretching the drum heads across the top and bottom of the body. The stretching mechanisms are adapted for movement towards and away from one another for respectively increasing and decreasing the tension in each of the top and bottom drum heads.

Specifically, a shaft having a threaded portion and an unthreaded top portion is positioned below the drum body. The top and bottom drum heads each have a stretchable central portion and an essentially rigid outer band portion peripherally connected to the central portion.

A hoop is provided which is configured to bear downwardly against the outer band portion of the top drum head. Further, a stretching wheel is rotatably connected to the top end of the shaft so as to be freely rotatable thereon. The stretching wheel has a peripheral portion configured to bear against the outer band portion of the drum head.

There also is provided a coupling wheel disposed below the stretching wheel and threadably engaged on the shaft. The coupling wheel is connected to the hoop by a plurality of circumferentially spaced tension rods. The arrangement is such that the heads, the hoop, the stretching wheel, the coupling wheel and the connecting rods are operatively connected together for conjoint rotation on the shaft.

In operation, rotation of the coupling wheel and the stretching wheel on the shaft in a selected direction produces a downward force on the outer band portion of the top drum head. By reason of such rotation, there is concurrently produced an upward force on the outer band portion of the bottom drum head to simultaneously stretch the top and bottom drum heads across the top and bottom of the drum body. The result is to permit the simultaneous adjustment of the pitch level in each of the top and bottom drum heads.

Additional features and advantages of the present invention will become more aparent from a consideration of the following detailed description when taken in conjunction with accompanying drawings.

DESCRIPTION OF THE PREFERRED EMBODIMENTS

Figure 1:
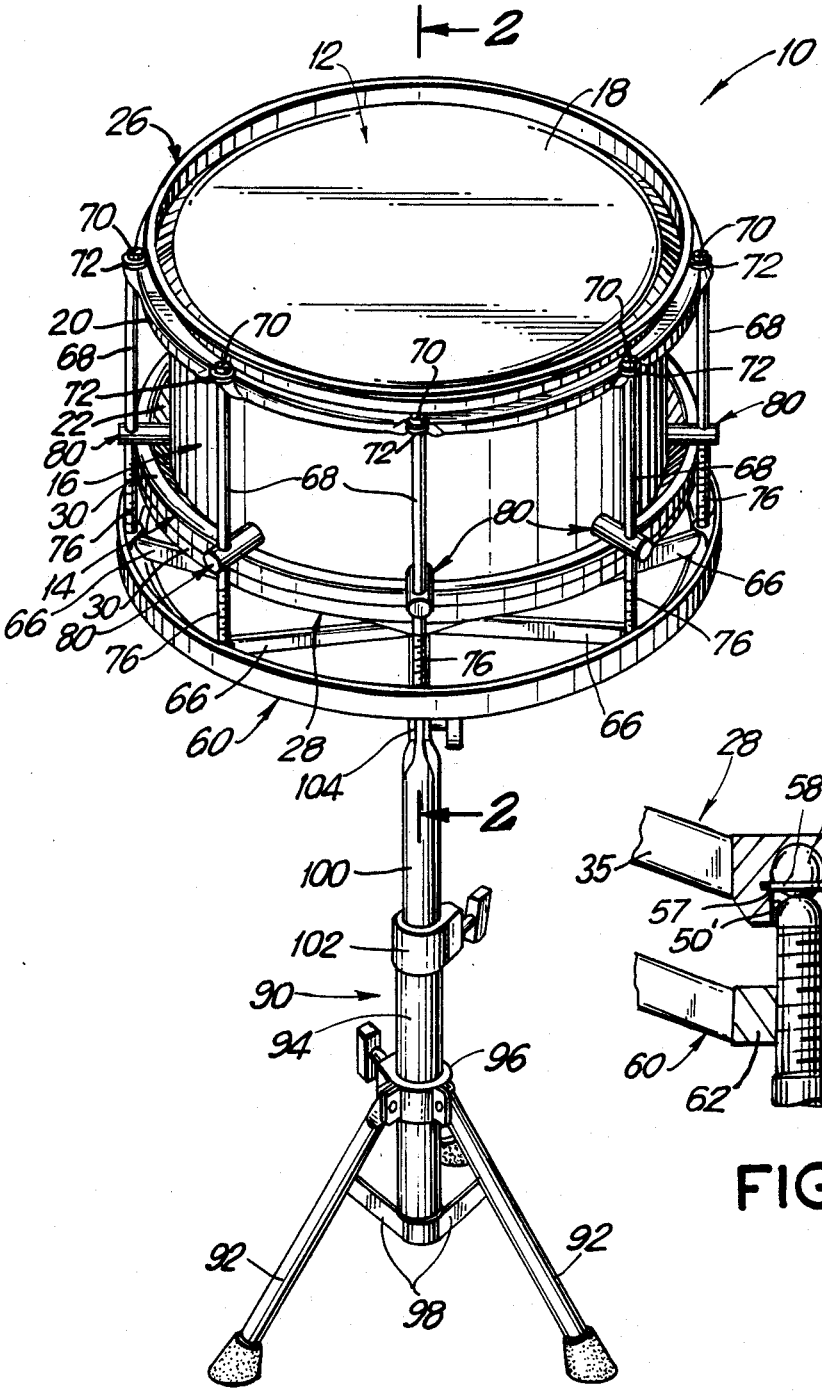
FIG. 1 is a perspective view of a percussion instrument in the nature of a drum constructed in accordance with the present invention.

Referring to the drawings, reference numeral 10 designates a percussion instrument in the nature of a drum constructed in accordance with the present invention. Drum 10 includes a pair of elastic top and bottom drum heads 12 and 14 stretched across the top and bottom of a shell-like drum body 16, preferably of cylindrical configuration. Top and bottom drum heads 12 and 14 are well known in the art and are readily obtainable. In this regard, the top drum head 12 has a stretchable, circular central portion 18 and an essentially rigid outer band-like portion 20 peripherally connected to central portion 18. Similarly, bottom drum head 14 preferably has a stretchable, circular central portion 22 and an essentially rigid outer band portion 24 peripherally connected to central portion 22. As illustrated, the diameter of each of the central sections 18 and 22 is greater than the diameter of body 16 to allow central sections 18 and 22 to stretch across the top and bottom of body 16. In this regard, body 16 preferably has a diameter of about 30.48 cm. and each of the top and bottom drum heads preferably has a diameter of about 35.56 cm. As will be hereinafter described in greater detail, central portion 18 is stretched across the top of drum body 16 by a downward force exerted against outer band portion 20, and central portion 22 is stretched across the bottom of body 16 by an upward force exerted against outer band portion 24.

When central section 18 of top drum head 12 is struck by a hand, a drumstick, a wire brush or another implement, it vibrates with a pitch level proportional to its tension. The vibration of central portion 18 propagates through the air within body 16 to cause central section 22 to sympathetically vibrate. The pitch level of bottom drum head 14 is proportinal to the tension in its central section 22. To this end, as is well known in the art, central section 22 of bottom drum head 14 preferably has a thickness of about one-half of the thickness of central section 18 of top drum head 12. A hoop 26, known well in the art and readily obtainable, is provided to downwardly bear against the outer band portion 20 of top drum head 12 in order to stretch central section 18 across the top of body 16. A stretching wheel 28 is provided to upwardly bear against outer band portion 24 of bottom drum head 14 in order to stretch central section 22 across the bottom of body 16. As will be discussed, hoop 26 and stretching wheel 28 are movable towards and away from one another for respectively increasing and decreasing the tension in each of the central sections 18 and 22.

Stretching wheel 28 has an outer peripheral portion 30 configured to upwardly bear against outer band portion 24 of bottom drum head 14, and a hub portion 32. A set of spokes 33 connect outer band portion 30 with hub 32.

Stretching wheel 28 is rotatably mounted on the top end of a threaded shaft 34. Preferably, shaft 34 is aligned with the central axis of drum body 16, and has an unthreaded top portion 36 of reduced diameter to define a shoulder 38. A thrust bearing 40 is provided having an inner race 42, an outer race 44 and a plurality of ball bearings 46 disposed between inner and outer races 42 and 46. Inner race 42 is receivable on top portion 36 of shaft 34 to bear against shoulder 38. Preferably, a brass washer 48 is positioned on unthreaded portion 36 of shaft 34 and is disposed between inner race 42 and shoulder 38. Hub 32 of stretching wheel 28 preferably has a bore 50 defined by an outer portion 52 and an inner portion 54 of reduced diameter joined to outer portion 52 to define an abutment ledge 56 to bear against outer race 44 when bearing 40 is received within the bore 50 of hub 32.

Figure 4:
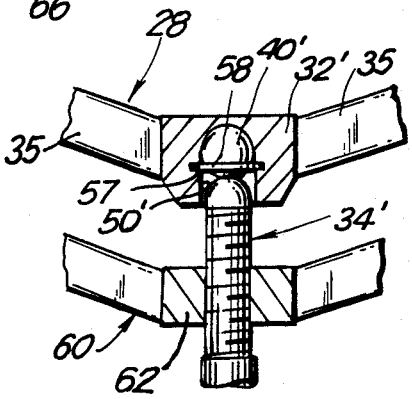
FIG. 4 is a framentary, sectional view illustrating an alternative embodiment of the rotatable connection of a stretching wheel to the top end of a shaft in accordance with the present invention.
Figure 2:
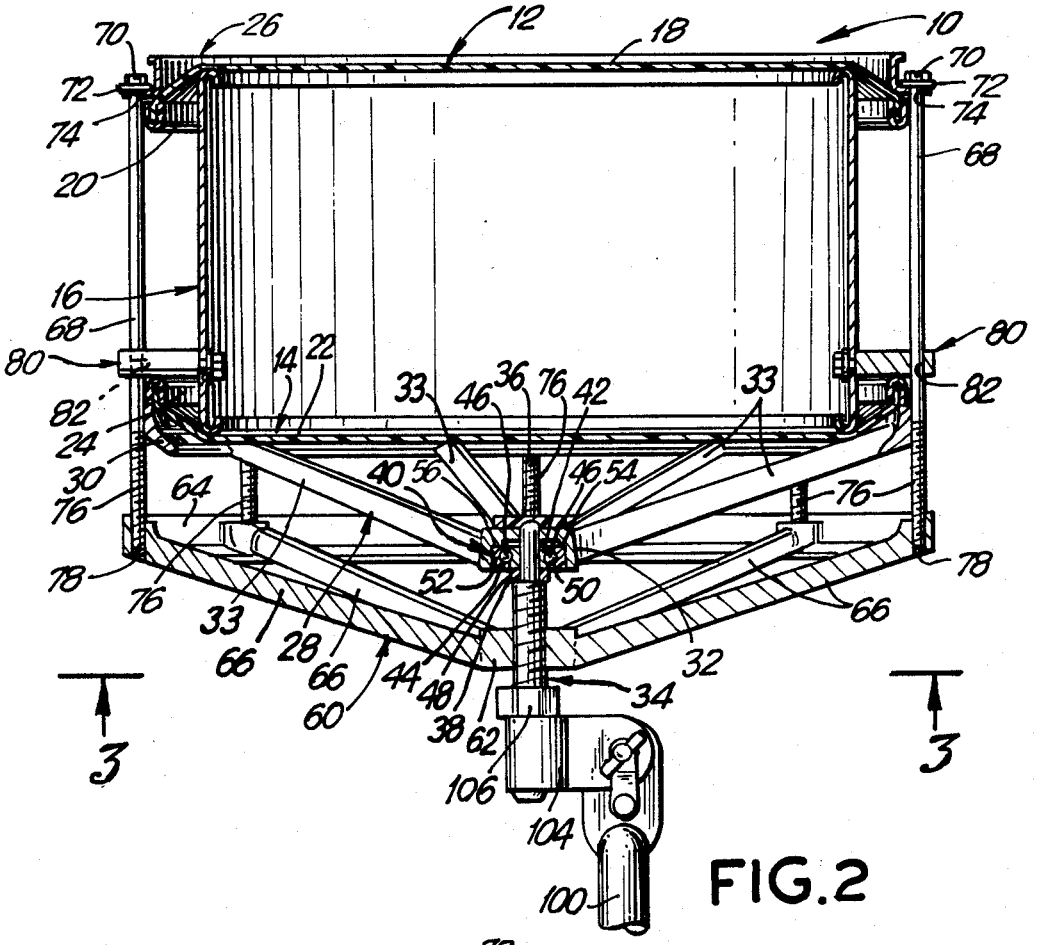
FIG. 2 is a sectional view taken along line 2—2 of FIG. 1.
Figure 3:
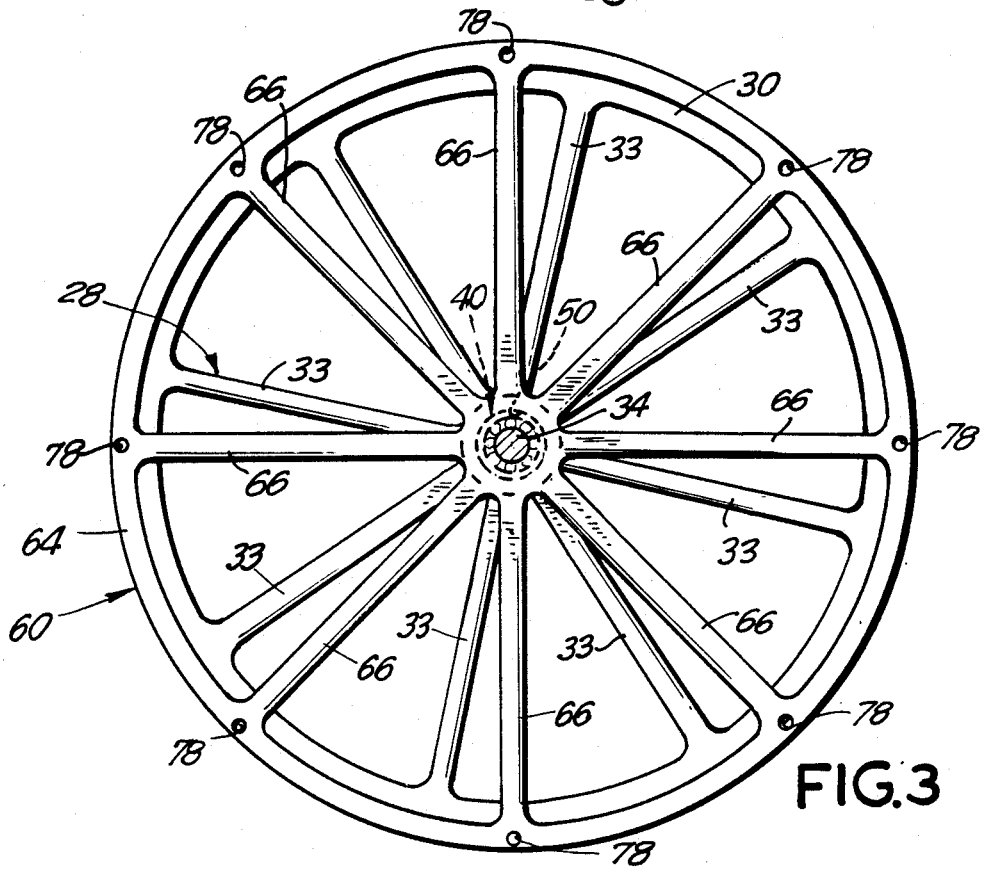
FIG. 3 is a sectional view taken along line 3—3 of FIG. 2.

With reference to FIG. 4, as an alternative embodiment, stretching wheel 28 may be provided with a hub 32' having a blind bore 50' configured to receive the top end of a threaded shaft 34' that is threaded throughout its length. A thrust bearing 40', that comprises a ball bearing, is receivable within bore 50' to bear against the top end of shaft 34'. As illustrated, blind bore 50' is provided with a circumferential groove 57 which receives a snap ring 58 to retain bearing 40' in place.

A coupling wheel 60 having a central hub 62 is threadably engaged on shaft 34, or in case of the alternative embodiment of FIG. 4, on shaft 34'. Hub 62 is connected to an outer peripheral portion 64 of coupling wheel 60 by a set of spokes 66. Outer peripheral portion 64 of coupling wheel 60 is, in turn, peripherally connected to hoop 26 by a set of circumferentally spaced tension rods 68. Each of the tension rods 68 has a head 70 that bears against a washer 72. Additionally, each tension rod 68 passes through a bore 74 provided in hoop 26. The opposite end of each of the tension rods 68 is provided with threads 76 and is threadably engaged within a set of threaded bore 78 defined in peripheral portion 64 of coupling wheel 60.

Preferably, shafts 34 and 34' have a right hand thread such that when coupling wheel 60, tension rods 68 and hoop 26 are rotated in a clockwise direction, coupling wheel 60 moves downwardly on either of the shafts in use. Downward movement of coupling wheel 60 produces a downward movement of tension rods 68 and also, a downward movement of hoop 26. The downward movement of hoop 26, in turn, causes outer band portion 20 of top drum head 12 to also move in a downward direction. The downward movement of outer band 20 is accompanied by a downward force exerted upon outer band portion 20 by hoop 26. As a result, central portion 18 of top drum head 12 stretches across the top of body 16. The downward force being exerted against outer band portion 20 and the downward movement of outer band portion 20 is transmitted through body 16 to central portion 22 of bottom drum head 14. The downward force being exerted against central portion 22 of bottom drum head 14 is transmitted to outer band portion 24 and exerted against outer peripheral portion 30 of stretching wheel 28. Since stretching wheel 28 is stationary relative to shaft 34, an upward reactive force is produced, at the top end of shaft 34, which is exerted against stretching wheel 28. The upward force is transmitted to outer band portion 24 of bottom drum head 14 through peripheral portion 30 of stretching wheel 28. The upward force exerted against outer band portion 24 and the downward movement exerted against central section 22 of bottom drum head 14 by the bottom of body 16 causes central section 22 of bottom drum head 14 to stretch across the bottom of body 16.

It follows from the above description, that the tension in each of the top and bottom drum heads 12 and 14 is simultaneously increased upon clockwise rotation of coupling wheel 60, and is simultaneously decreased by counterclockwise rotation of coupling wheel 60. The simultaneous increase in tension in each of the top and bottom drum heads 12 and 14 produces an increase of pitch level in each of the top and bottom drum heads 12 and 14. The simultaneous decrease in tension of each of the top and bottom drum heads 12 and 14 produces a decrease of pitch level in each of the top and bottom drum heads 12 and 14.

The downward force exerted by hoop 26 against outer band portion 20 of top drum head 12 and the upward force exerted by outer peripheral portion 30 of stretching wheel 28 against outer band portion 24 of bottom drum head 14 produces a frictional engagement between hoop 26 and outer band portion 20 of top drum head 12, central portion 18 of top drum head 12 and the top end of body 16, the bottom end of body 16 and central portion 22 of bottom drum head 14, and outer band portion 24 of bottom drum head 14 and outer peripheral portion 30 of stretching wheel 28. The aforesaid frictional engagements cause top drum head 12, body 16, bottom drum head 14, hoop 26, and stretching wheel 28 to rotate on or relative to shaft 34 conjointly with rotation of coupling wheel 60 and its associated extension rods 68. The thrust bearing minimizes the frictional engagement of stretching wheel 28 with the shaft to permit such conjoint rotation with a minimum of wear in central sections 18 and 22 of top and bottom drum heads 12 and 14, respectively.

In addition to the frictional engagement between central portion 18 of top drum head 12 and the top of body 16 that causes body 16 to rotate with hoop 26, tension rods 68 are preferably connected to body 16 such that rotation of coupling wheel 26 and tension rods 68 produce a rotation of body 16. This connection is preferably accomplished by a set of radially oriented projections 80 connected to the outer surface of body 16. Each of the projections 80 has a bore 82 configured to receive tension rods 68.

As previously mentioned, downward movement of outer band portion 20 produces a downward movement of body 16 against central portion 22 of bottom drum head 14. Stretching wheel 34, although stationary with respect to the shaft, is not stationary with respect to drum body 16. In fact, outer peripheral portion 30 of stretching wheel 28 moves upwardly relative to the bottom end of body 16 and produces an upward movement of outer band portion 24 of bottom drum head 14. Projections 80 are spaced from the bottom of drum body 14 so as to limit upward movement of band 24. This limitation of upward movement limits the magnitude of the upwardly directed force applicable to the outer band portion 24 of bottom drum head 14 by stretching wheel 28. This is necessary because, as mentioned above, the thickness of central portion 22 of bottom drum head 14 is preferably approximately half that of central portion 18 of top drum head 12. The limitation of the upward force applied to bottom drum head 14 limits the tension that may be produced in bottom drum head 14 to prevent the bottom of body 16 from tearing or rupturing central portion 22 of the drum head.

Percussion instrument 10 may be supported by a variety of conventional supporting structures known well in the art. For exemplary purposes, percussion instrument 10 is illustrated as being supported by a drum stand 90 which has a set of collapsible legs 92 adjustably connected to a lower tube 94 by means of a clamp 96 and a set of struts 98. An upper tube 100 is telescoped within lower tube 94 and may be moved either upwardly or downwardly to adjust the height of percussion instrument 10. A height adjustment clamp 102 locks upper tube 100 in place. Either of the shafts 34 or 34' are connected to the top end of tube 100 by an angle adjustment clamp 104 and associated nut 106. Clamp 104 may be set in an angle from the vertical to angularly position percussion instrument 10 from the vertical, as desired, when the drum is being played.

Although the engagement between coupling wheel 60 and either of the shafts 34 or 34' is illustrated as a threaded engagement, other engagements are possible. For instance, although not illustrated, the shaft might comprise a rack and the engagement of the coupling wheel to the rack might be effectuated by a mechanical mechanism, such as a worm gear, connected for rotation to coupling wheel 60. The worm gear might be manually set in motion by a knob or by a reversible electric motor. In such a possible embodiment, downward and upward advancement of the coupling wheel on the rack would simultaneous adjust the pitch level in each of the top and bottom drum heads without any rotational movement of the coupling wheel of the drum.

While preferred embodiments of the invention have been shown and described in detail, it would be readily understood and appreciated that numerous omissions, changes and additions may be made without departing from the spirit and scope of the present invention.

I claim:

1. A percussion instrument in the nature of a drum comprising:

a shell-like body;

a pair of elastic top and bottom drum heads adapted to be stretched across the top and bottom of said body for vibrating at a pitch level proportional to the tension produced in each of said heads;

a pair of top and bottom stretching means engaging said top and bottom drum heads, respectively, for stretching said drum heads across the top and bottom of said body, said stretching means adapted for movement towards and away from one another for respectively increasing and decreasing the tension in each of said top and bottom drum heads;

a connecting structure connected at one end to said top stretching means;

a shaft positioned below said drum body and connected at its top end to said bottom stretching means; and coupling means operatively associated with said shaft and connecting the opposite end of said connecting structure to said shaft, said coupling means being movable relative to said shaft to cause said connecting structure to exert a downward force on said top stretching means, and concurrently therewith produce an upward reactive force, at the top of said shaft, on said bottom stretching means to simultaneously stretch said top and bottom drum heads across the top and bottom of said body, and to thereby simultaneously adjust the pitch level in each of said top and bottom drum heads.

2. The percussion instrument of claim 1 wherein:

said drum body is of cylindrical configuration;

said top and bottom drum heads each comprising a circular stretchable central portion and an essentially rigid outer band portion peripherally connected to said central portion, said central portion having a diameter greater than the diameter of said drum body; and said top stretching means bears downwardly against said outer band portion of said top drum head, and said bottom stretching means bears upwardly against said outer band portion of said bottom drum head when said coupling means is moved relative to said shaft.

3. The percussion instrument of claim 2 wherein:

said shaft is threaded and is aligned with the central axis of said drum;

said coupling means includes a coupling wheel centrally and threadably engaged on said shaft and peripherally connected to said opposite end of said connecting structure; and said bottom stretching means includes a stretching wheel having a central hub for rotatably connecting said wheel to the top end of said shaft so as to be freely rotatable thereon, said stretching wheel disposed above said coupling wheel on said shaft and having a peripheral portion configured to bear against said outer band portion of said bottom drum head;

whereby rotation of said coupling wheel and said stretching wheel on said shaft in a selected direction simultaneously stretches said top and bottom drum heads across the top and bottom of said body.

4. The percussion instrument of claim 3 wherein said body, said top and bottom drum heads, said top and bottom stretching means, said connecting structure and said coupling means are operatively connected together for conjoint rotation on said shaft.

5. The percussion instrument of claim 3 wherein: said shaft has an unthreaded top portion of reduced diameter to define a shoulder;

said instrument further comprising a thrust bearing having an inner race, an outer race and a plurality of ball bearings between said inner and outer races, said inner race receivable on said top portion of said shaft to bear against said shoulder;

the hub of said stretching wheel having a bore defined by a outer portion configured to receive said thrust bearing, and an inner portion of reduced diameter joined to said outer portion to define an abutment ledge which bears against said outer race.

6. The percussion instrument of claim 3 wherein the hub of said stretching wheel has a blind bore configured to receive the top end of said shaft, said instrument further comprising a ball bearing receivable within said bore which bears against the top end of said shaft.

7. The percussion instrument of claim 3 wherein:

said top drum head stretching means comprises a hoop configured to bear downwardly against said outer band portion of said top drum head; and said connecting structure includes a set of circumferentially spaced tension rods connecting said hoop to said coupling wheel, said rods extending downwardly of said drum body to a level spaced below said stretching wheel.

8. The percussion instrument of claim 7 wherein said drum body further includes a set of radially oriented projections connected to the outer surface of said drum body and having a set of vertically oriented bores configured to receive said tension rods, the projections being spaced from the bottom of said drum body so as to limit upward movement of said outer band portion of said bottom drum head produced by upward movement of said stretching wheel, thereby to limit the upward force applicable to the outer band portion of said bottom drum head and limit the tension produced in said bottom drum head.

9. A percussion instrument in the nature of a drum comprising:

a shell-like body of cylindrical configuration;

a shaft positioned below said drum body, said shaft being aligned with the central axis of said drum and having a threaded portion and an unthreaded top portion;

a pair of elastic top and bottom drum heads adapted to be stretched across the top and bottom of said body for vibrating at a pitch level proportional to the tension produced in each of said heads;

said top and bottom drum heads each comprising a circular stretchable central portion and an essentially rigid outer band portion peripherally connected to said central portion, said central portion having a diameter greater than the diameter of said drum body;

a hoop configured to bear downwardly against the outer band portion of said top drum head;

a stretching wheel having a central hub portion for rotatably connecting said wheel to the top end of said shaft so as to be freely rotatable thereon, said stretching wheel having a peripheral portion configured to bear against the outer band portion of said bottom drum head;

a coupling wheel centrally and threadably engaged on said shaft, said coupling wheel disposed below said stretching wheel on said shaft;

a set of circumferentially spaced tension rods connecting said coupling wheel to said hoop; and said drum body, said top and bottom drum heads, said hoop, said stretching wheel, said coupling wheel and said connecting rods being operatively connected together for conjoint rotation on said shaft;

whereby rotation of said coupling wheel and said stretching wheel on said shaft in a selected direction produces a downward force on the outer band portion of said top drum head, and concurrently therewith produces an upward force on the outer band portion of said bottom drum head to simultaneously stretch said top and bottom drum heads across the top and bottom of said drum body, and to thereby simultaneously adjust the pitch level in each of said top and bottom drum heads.

* * * * *